United States Patent [19]

Morgan

[11] Patent Number: 5,074,205

[45] Date of Patent: Dec. 24, 1991

[54] PRINTING APPARATUS

[76] Inventor: John H. Morgan, Abbey Mill, Kingswood, Wotton-under-Edge Cloucestershire, United Kingdom

[21] Appl. No.: 579,333

[22] Filed: Sep. 6, 1990

Related U.S. Application Data

[63] Continuation of Ser. No. 228,913, Aug. 3, 1988, abandoned.

[51] Int. Cl.[5] ..... B41F 13/20; B41F 13/30; B41F 13/44

[52] U.S. Cl. ..... 101/181; 101/247

[58] Field of Search ..... 101/247, 181, 219, 216, 101/182, 136, 137, 138, 139, 140, 143

[56] References Cited

U.S. PATENT DOCUMENTS

| | | | |
|---|---|---|---|
| 2,690,121 | 9/1954 | Auerbacher et al. | 101/247 |
| 3,043,216 | 7/1962 | Meyer | 101/179 |
| 3,163,109 | 12/1964 | Stelling, Jr. | 101/219 |
| 3,323,452 | 6/1967 | Pasquinelli | 101/218 |
| 3,470,816 | 10/1969 | Piecha et al. | 101/218 X |
| 3,606,835 | 9/1971 | Chambon | 101/218 |
| 4,462,311 | 7/1984 | Armelin | 101/218 |

FOREIGN PATENT DOCUMENTS 2046664 11/1980 United Kingdom .

*Primary Examiner*—J. Reed Fisher
*Attorney, Agent, or Firm*—Woodard, Emhardt, Naughton, Moriarty & McNett

[57] ABSTRACT

The apparatus comprises a plate cylinder 15, a blanket cylinder 16 and an impression cylinder 17. A web W passes between the blanket and impression cylinder to enable print to be applied to the web by the blanket cylinder. The plate and blanket cylinders 15,16 are provided as a one piece cartridge movable axially to a position offset from the web. The impression cylinder 17 is also movable independently of the other cylinders to a position offset from the web to enable the impression cylinder to be changed without breaking the web or removing the web from the apparatus.

16 Claims, 5 Drawing Sheets

15
90
80
85
86
82
83
84
76
77
75
88
78
16
66
67
64
65
17
24
53
54
55
24
47
56
58
63
52
59
62
60
57
1
80
85
87
84
92
15
16
77
89
W
21
66
68
17
24
72
44
71
50
49
73
48
46
42
45
40
43
1

PRINTING APPARATUS

This application is a continuation of application Ser. No. 288,913, filed Aug. 3, 1988 now abandoned.

BACKGROUND OF THE INVENTION

The invention relates to printing apparatus and it is particularly concerned with printing apparatus such as an offset lithographic printing apparatus, which utilises a cylinder for applying print to a web.

Known offset lithographic printing machines comprise a plate cylinder to which ink is applied by rollers, a blanket cylinder which transfers the print from the plate cylinder to a web, and an impression cylinder which presses the web against the blanket cylinder. The blanket cylinder, will have a circumference corresponding either to the total print length or to a print length which is exactly divisible into the circumferential length of the blanket cylinder. Where a customer requires a print length which will not divide exactly into the circumferential length of the blanket cylinder, it is necessary to change the cylinder and, hitherto, it has been proposed to mount the blanket cylinder and plate cylinder in a cartridge which can be withdrawn axially to one side of the web. By doing that, the plate and blanket cylinders can be changed or cleaned easily.

If it is necessary to print on both sides of a web, it is usual to pass the web through a first print tower where print is applied to one side of the web, invert the web downstream of the first print tower and then pass the inverted web through a second print tower which applies print to the opposite side of the web. By doing that, the previously printed side of the web comes into engagement with the impression cylinder of the second print tower. As the printing is normally carried out at high speed, the ink applied to the first side of the web will often not be completely dry by the time it comes into engagement with the impression cylinder of the second print tower and ink will be transferred to that impression cylinder. Provided that the impression cylinder of the second print tower has a circumferential length which can be divided exactly by the print length applied by the first print tower, no problems arise. However, if the impression cylinder circumference is not so divisible, what is known as "ghosting" can occur where a second but lighter image of the print applied to the first side of the web is applied again to that side by the impression cylinder of the second print tower. Therefore, where the plate and blanket cylinders are changed in an upstream print tower it will generally be necessary to change both the plate and blanket cylinders and the impression cylinder of the downsteam tower in order to ensure that ghosting does not occur. In view of the fact that the web passes over the impression cylinder, it is necessary to remove the web from known machines when changing the impression cylinder which can be most inconvenient, particularly if numerous print towers are present in the machine. It is well known, that re-webbing a printing machine can be a long and complex operation and increases the time that the machine is out of service.

On certain prior art machines, it is known to provide the plate cylinder, blanket cylinder and impression cylinder as a single unit which can be mounted into or dismantled from a printing machine and an operator can carry various units having cylinders of set sizes. However, such units are very expensive as each one incorporates three cylinders and the unit is very heavy and difficult to install and remove. Also, it is essential to remove the web from the machine in order to replace the three-cylinder units.

SUMMARY OF THE INVENTION

An object of the present invention is to provide printing apparatus which enables at least the impression cylinder across which the web passes to be replaced without having to break the web or remove the web from the machine.

According to one aspect of the invention there is provided printing apparatus comprising a printing cylinder for applying print to a web and an impression cylinder for maintaining the web against the printing cylinder, said printing cylinder being movable axially to a position offset from the web, said impression cylinder being movable axially independently of the printing cylinder to a position offset from the web.

According to another aspect of the invention there is provided printing apparatus comprising a printing cylinder for applying print to a web and an impression cylinder for maintaining the web against the printing cylinder, said impression cylinder being movable axially relative to the printing cylinder to a position offset from the web.

An arrangement as set out in either of the two immediately preceding paragraphs enables the impression cylinder to be moved to a position to one side of the web so that the impression cylinder can be changed without having to break the web or remove the web from the machine.

Preferably, the impression cylinder is mounted on slide means whereby the impression cylinder can be slid to the offset position.

The impression cylinder is preferably mounted between spaced support means, e.g. side plates. The impression cylinder may be rotatably mounted in journal bearings on the support means. The support means may have surfaces which engage the aforesaid slide means. Such surfaces may comprise arcuate cut-outs which rest on the slide means and which may be slidable therealong.

Such surfaces may be arranged on lower edges of said support means.

The printing cylinder, which is preferably a blanket cylinder co-operable with a plate cylinder, may be mounted between spaced further support means such as further side plates. The further support means may be carried by mounting means which enables the printing cylinder to be moved axially to a position offset from the web. The mounting means may be slidable on bearings and preferably takes the form of rails.

In a preferred embodiment, the printing and impression cylinders are arranged in a print tower of a printing machine downstream of a further print tower of the machine. Preferably, the further print tower applies print, in use, to one side of the web and the downstream print tower applies print to the opposite side of the web, the web moving through an inverting station between the print towers.

The impression cylinder and printing cylinder may be rotatably fast with meshing gear wheels which disengage each other when one of the cylinders is moved to its offset position. The impression cylinder gear wheel is preferably arranged to transmit drive to the printing cylinder gear wheel. Where a plate cylinder is provided, the printing (i.e. the blanket) cylinder gear wheel preferably meshes with a gear wheel rotatably fast with the plate cylinder so as to drive the latter. Preferably the impression cylinder gear wheel disengages a driving gear when the impression cylinder is moved to its offset position.

In a preferred embodiment drive from a main drive input is transmitted to the impression cylinder through an adjustable roller gear. The idler gear may be rotatably mounted on a movable arm to enable the position of the idler gear to be adjusted to mesh with respective gear wheels on impression cylinders of different sizes. In that way different sized impression cylinder gear wheels can easily be made to mesh with the idler gear, the latter preferably being in constant mesh with a drive gear. Preferably the arm is pivotable about an axis of said drive gear.

Locking means, such as a screw and locknut arrangement, may be provided for locking said arm in position once the idler gear and impression cylinder gear are in mesh.

Printing apparatus in accordance with the invention will now be described by way of example with reference to the accompanying drawings in which:

DESCRIPTION OF THE PREFERRED EMBODIMENT

Figure 1:
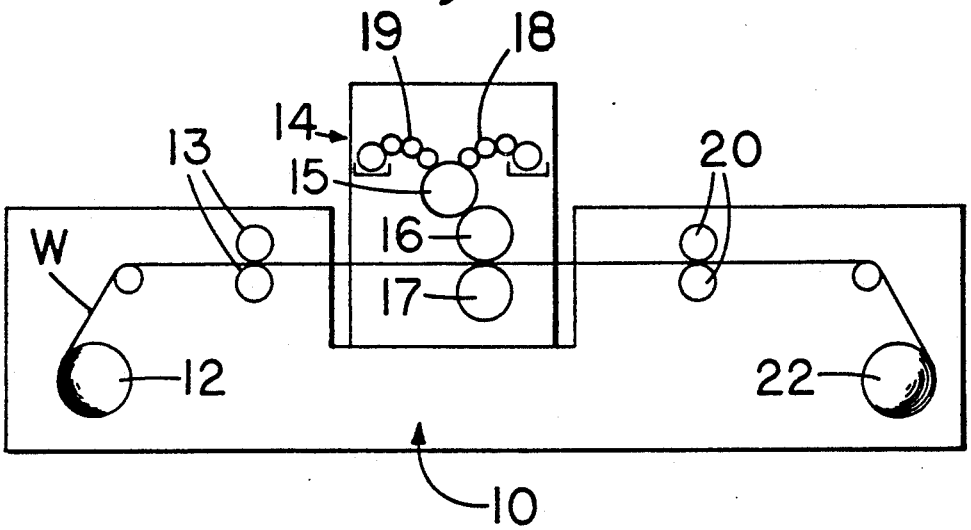
FIG. 1 is a diagrammatic elevation of basic offset lithographic printing machine.

Referring to FIG. 1, the basic offset lithographic printing machine comprises a main frame or bed 10 carrying a supply of paper web 12 which passes between feed rollers 13 arranged upstream of a print tower 14. The print tower contains the usual plate cylinder 15, blanket cylinder 16 and impression cylinder 17. Ink is applied to the plate cylinder 15 by a roller system 18 and moisture is applied to the plate cylinder 15 by a moistening roller system 19 in known manner. The printed web passes between take-up rollers 20 and is collected by a web take-up 22.

Figure 2:
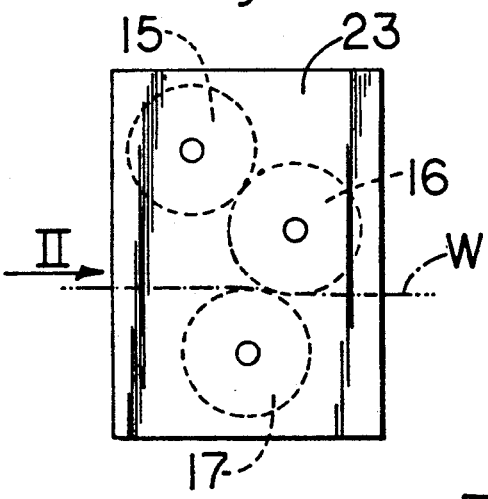
FIG. 2 is a diagrammatic elevation of a known type of plate blanket and impression cylinder arrangement.
Figure 2A:
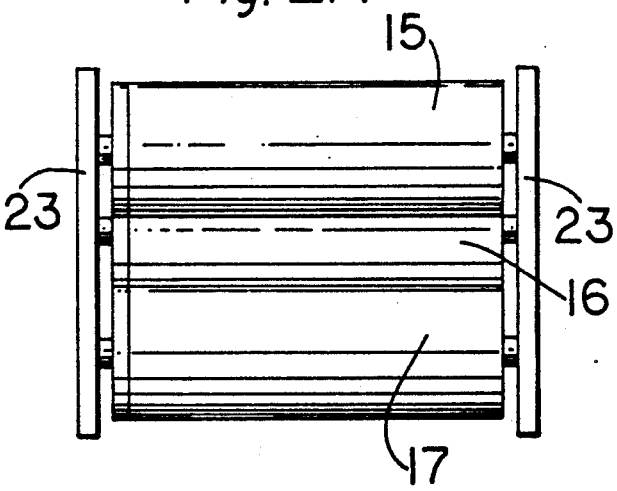
FIG. 2*a* is a view of the arrangement of FIG. 2 looking in the direction of arrow II in FIG. 2.

Hitherto, it has been known to mount the cylinders 15, 16 and 17 between steel side plates 23 as in FIGS. 2 and 2A to form a one piece unit. The unit can be installed or removed from the bed of the machine where a change of cylinder size is necessary. In order to maintain accuracy between the three cylinders, the side plates 23 have to be extremely robust and, as a result, the unit is generally very heavy and somewhat difficult to handle. Moreover, each of the units is expensive because it contains three complete cylinders whereas, in fact, on ocassions it may be necessary only to change the impression cylinder, or to change the plate and blanket cylinders. We have previously proposed machines which have the plate and blanket cylinders mounted on a cartridge which will enable the plate and blanket cylinders to be changed independently of the impression cylinder, the latter remaining in place in the bed of the machine and being lifted out after removal of the web. Whilst this particular arrangement has been found satisfactory, it is still necessary to break the web or remove the web from the printing machine when lifting the impression cylinder out of the bed.

Figure 5:
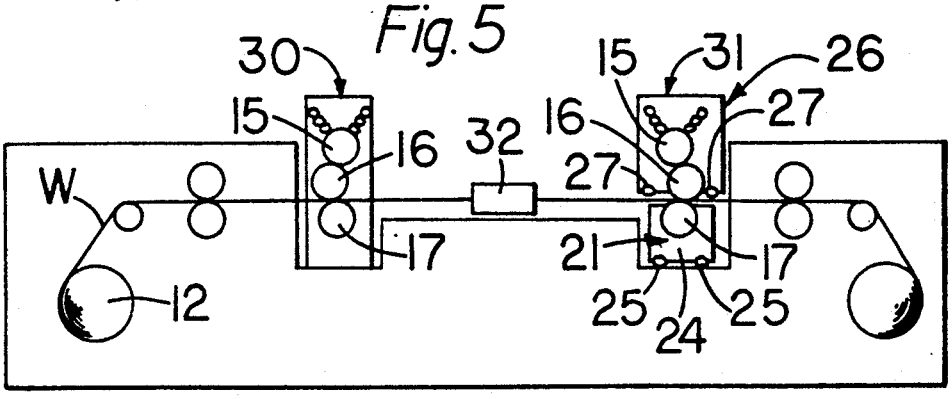
FIG. 5 is a diagrammatic elevation of an offset lithographic printing machine having two print towers one of which includes apparatus in accordance with the invention.
Figure 3:
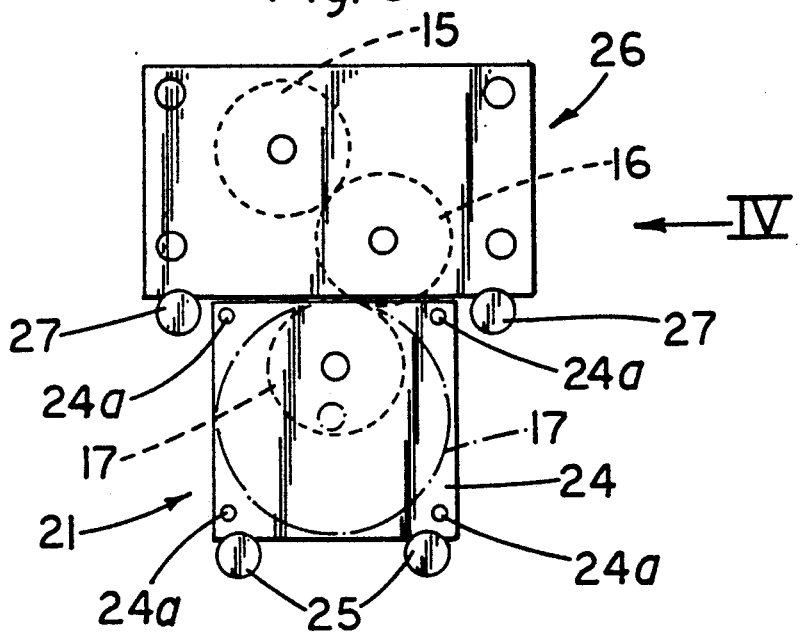
FIG. 3 is a diagrammatic elevation of a cylinder arrangement of an offset lithographic printing apparatus in accordance with the invention.
Figure 4:
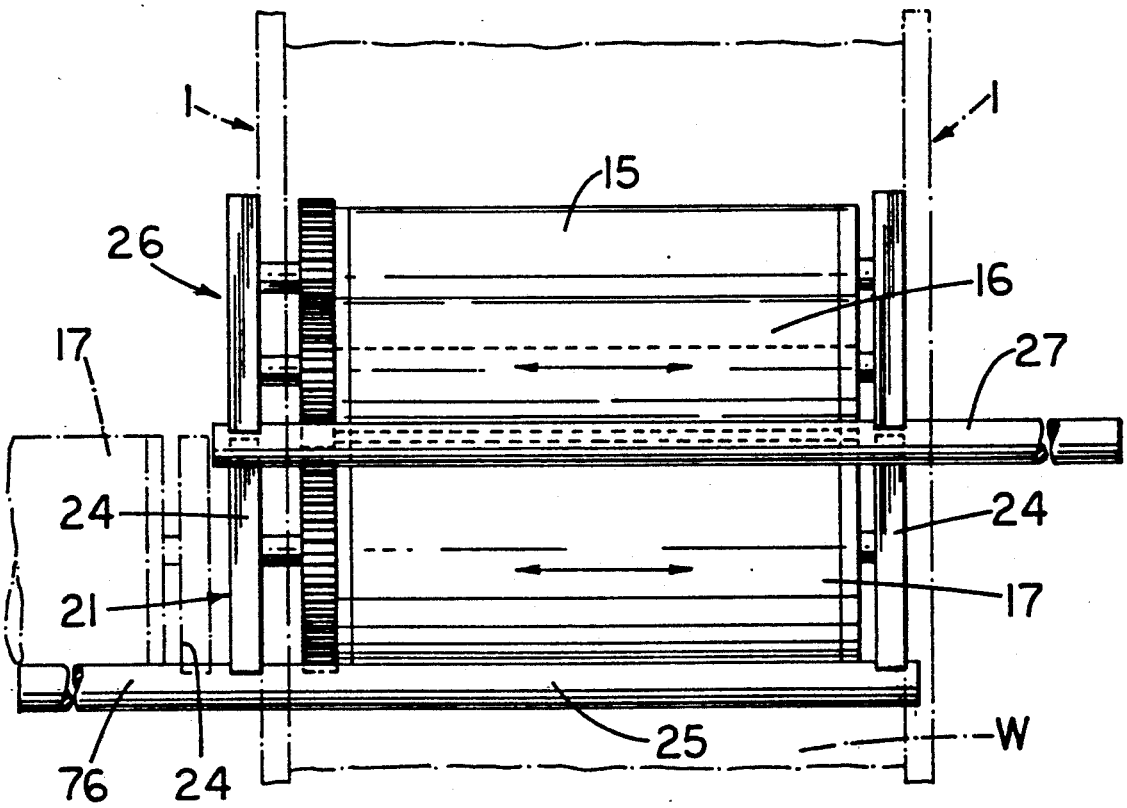
FIG. 4 is a view of the cylinder arrangement of FIG. 3 looking in the direction of arrow IV in FIG. 3.

Therefore, in accordance with the invention, the impression cylinder as shown in FIGS. 3 and 4 is mounted between end plates 24 spaced apart by suitable bars 24*a*. (FIG. 3). The impression cylinder and side plate arrangement then constitutes a single cartridge 21 which is slidable on guide bars 25 mounted on main supporting plates 1 on a bed, so that the impression cylinder can be shifted to one side of the web W. In that way, it is possible to slide the impression cylinder 17 axially clear of the web as indicated in broken lines in FIG. 4 so that it can be changed without the need to remove the web from the machine. The plate and blanket cylinders 15, 16 are also mounted in a single cartridge 26 on guide rails 27. The FIG. 3 arrangement is particularly useful where a machine is provided having more than one print tower as in FIG. 5 the upstream print tower 30 being arranged to print on one side of the web W and the downstream print tower 31 being arranged to print on the reverse side of the web, the web being inverted at an inverting station 32 between the towers. As mentioned above, it is usual practice to invert the web for printing by the second print tower 31 and, in such a case, it is important that the impression cylinder 17 in the downstream tower 31, has a circumferential length which is exactly divisible by the print length applied by the upstream print tower. If the downstream print tower in such case has an impression cylinder not so divisible, it has previously been necessary to break or remove the web and lift out the impression cylinder 17 of the downstream print tower 31 or to replace all three cylinders if the tower has the three cylinder single unit arrangement shown in FIG. 2. FIG. 5 shows the downstream print tower having an arrangement of cylinders in accordance with the invention. The present invention avoids the need to remove the web when changing the impression cylinder 17 of the downstream print tower 31. Also the dual cartridge arrangement shown in FIGS. 3, 4 and 5 enables the side plates to be less robust than in FIG. 2 as they do not need to support three heavy cylinders. Therefore the FIG. 3 arrangement is a less expensive proposition. An alternative size impression cylinder is indicated in broken lines in FIG. 3.

FIG. 4 shows the way in which the guide rails 25, 27 may extend beyond opposite sides of the web so that the blanket cylinder and plate cylinder cartridge 26 can be moved to the right as viewed in FIG. 4 whilst the impression cylinder cartridge 21 can be moved to the left. In that way, balance is maintained if both sets of cylinders are shifted axially to clear the web at the same time.

Figure 6:
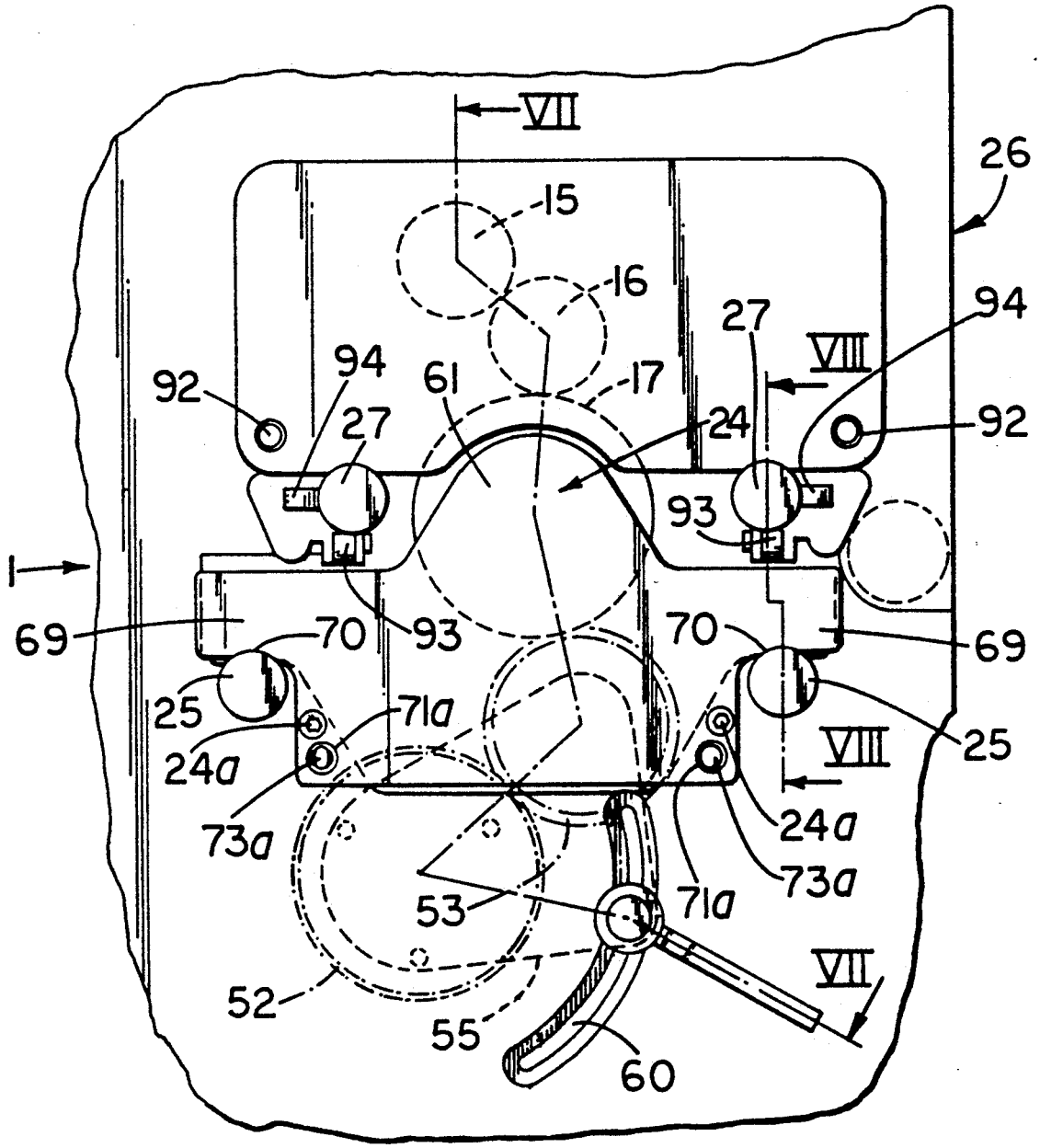
FIG. 6 is an elevation of a preferred form of printing apparatus in accordance with the invention.
Figure 7:
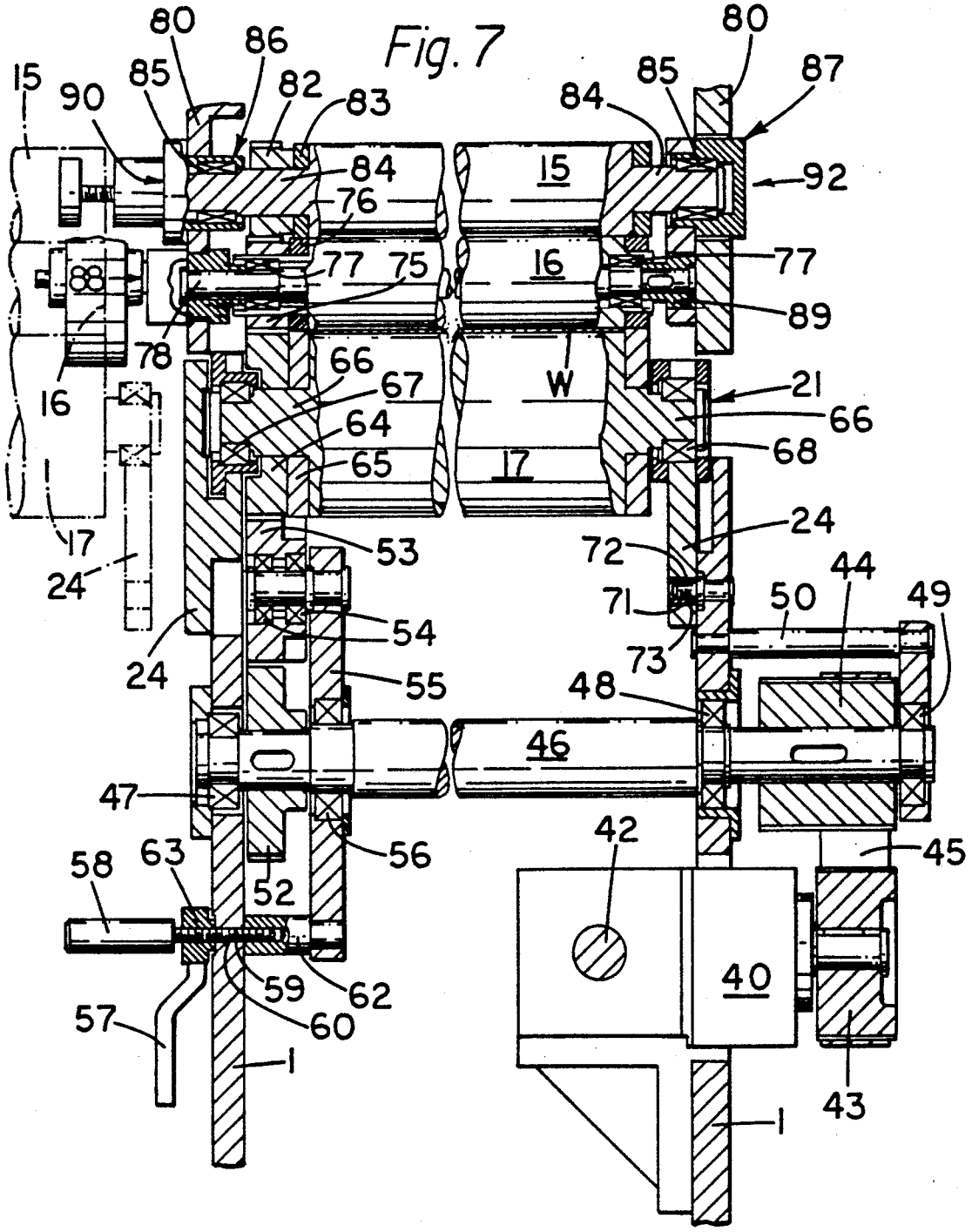
FIG. 7 is a cross section of the apparatus in FIG. 6 on the line VII—VII in FIG. 6.
Figure 8:
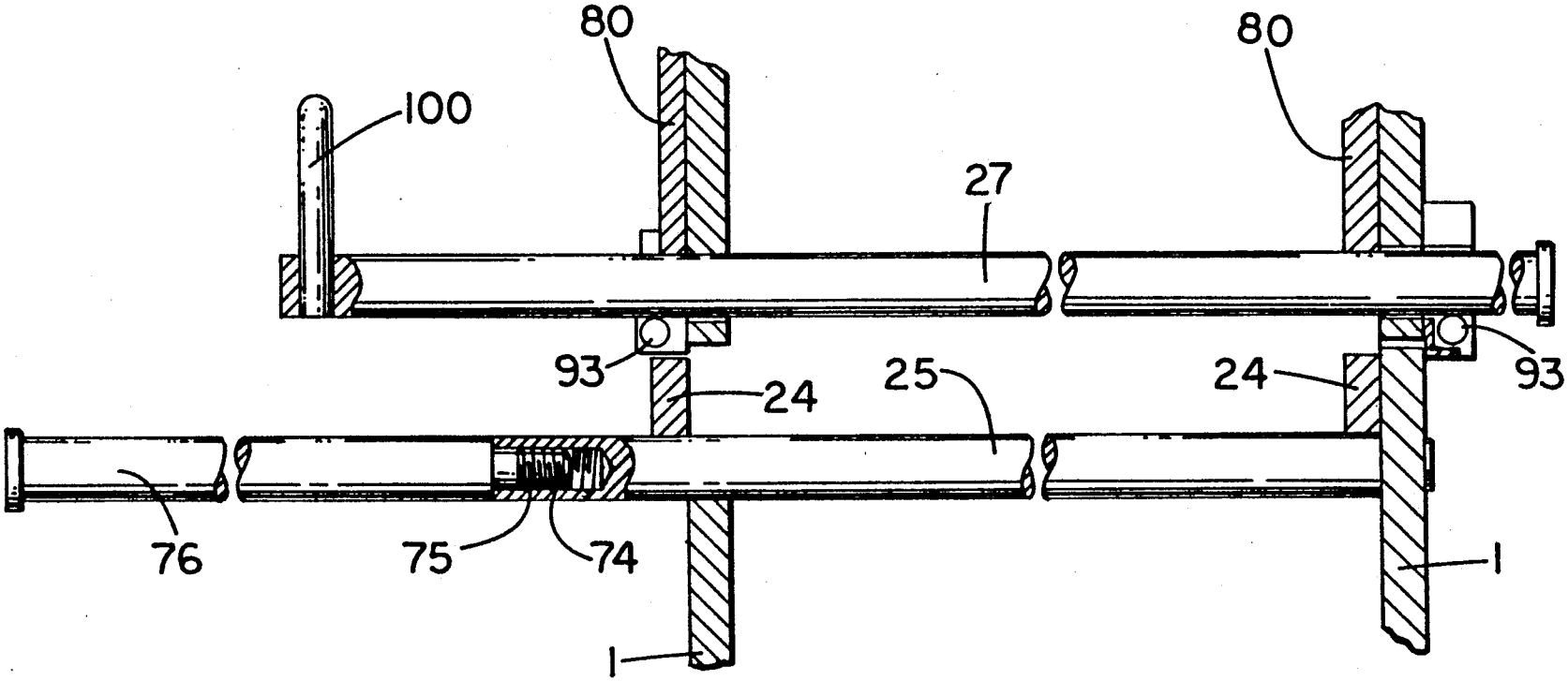
FIG. 8 is a cross section of the apparatus in FIG. 6 on the line VIII—VIII in FIG. 6.

Reference is now made to FIGS. 6 to 8 which show a preferred form of apparatus in accordance with the invention. Parts in FIGS. 6 to 8 which correspond to parts in FIGS. 1 to 5 carry the same reference numerals.

The main supporting plates 1 are spaced apart as shown in FIG. 7. The right hand main plate 1 carries a gearbox 40 which receives drive from a drive input shaft 42 driven by a main motor (not shown). The gear box 40 has an output shaft carrying a sprocket 43 from which drive is transmitted by a belt 45 to a sprocket 44 on a driving shaft 46. The sprocket 44 also transmits drive to roller systems 18, 19 of the type shown in FIG. 1 by means of a toothed belt (not shown). The driving shaft 46 is rotatably mounted in main bearings 47, 48 on the main plates 1 and by an outer bearing 49 supported by mounting bars 50 (one only of which is shown) on the right hand main plate 1. The driving shaft 46 is rotatably fast with a drive gear 52 which meshes with an idler gear 53 rotatbly mounted on bearings 54 on an arm 55. The arm 55 is mounted for rotation on a bearing 56 on the driving shaft 46. The arm carries an adjustment handle 58 and rotatable locking bar 57. The handle includes a screw threaded shaft 59 which projects through an arcuate slot 60 in left hand main plate 1 and screws into a projection 62 on the arm 55. The locking bar 57 has a boss 63 which is screw threaded on to the shaft 59 and acts as a lock-nut for the shaft 59. With the boss 63 in a non-locking condition, the handle 58 can be moved up or down in the slot 60 to turn the arm 55 about bearing 56 and cause the idler gear 53 to roll around the drive gear 52. Once in the desired position the locking bar 57 is turned to engage adjacent main plate 1 and lock the shaft 59 against that main plate.

The idler gear 53 is positioned to mesh with a gear wheel 64 rotatably fast with an impression cylinder 17. A spacer 65 is positioned between the gear wheel 64 and the impression cylinder 17., The impression cylinder is integral with mounting shafts 66 which are rotatable in bearings 67, 68. The bearings 67, 68 are mounted in side plates 24 which are held spaced apart by suitable bars **24*a*. As apparent from FIG. 6, the left hand side plate 24 in FIG. 7 has two arms 69, the lower edge of each of which is formed with an arcuate cut-out 70. The cut-outs 70 rest on the upper edges of respective guide rails 25 extending between and mounted rigidly on the main plates 1 (FIG. 8). The bearings 67, 68 are mounted in an upward extension 61 of each side plates 24 and are tied together by bars 24*a* to form a one-piece unit or cartridge 21 which is slidable to the left from the full line position shown in FIG. 7 to the broken line position (shown in part only). In the broken line position, the impression cylinder 17 is positioned to one side of the web W and can therefore be changed without having to break the web or remove the web from the printing machine. In the broken line position, the gear wheel 64 disengages the idler gear 53 and the new impression cylinder will have a different size wheel 64. In order to ensure that the new gear wheel 64 meshes with the idler gear, the position of the latter is adjusted into mesh by turning arm 55 with handle 58 when the new impression cylinder is moved into the full line position in FIG. 7. The right hand side plate 24 (which has a similar profile to the left hand plate 24 as viewed in FIG. 6) is formed with two dowel apertures 71 fitted with bushes 72. The apertures 71 (one only of which is shown) receive dowels 73 on the right main plate 1 which ensure positive location of the impression cylinder cartridge 21 relative to the plate 1. Similar dowels 73*a* (FIG. 6) are provided on the left main plate 1 for location in dowel-receiving apertures 72*a* in the left hand plate 24 for positive location. Once in the FIG. 7 full line position, suitable locking means (not shown) is provided to hold the cartridge 21** in place.

FIG. 8 shows the guide rails 25 in greater detail. The left hand end of each rail 25 is formed with an axial screw-threaded bore 74 which receives a screw-threaded reduced diameter end 75 of an extension rail 76. The extension rails 76 have the same outer diameter as the rails 25 and are fitted when it is desired to move the impression cylinder cartridge 21 to the left clear of the web W. The arrangement shown in FIG. 4 is very similar, the main guide rail being shown at 25 and the extension at 76.

The gear wheel 64 meshes with a gear wheel 75 rotatably fast with a blanket cylinder 16. A spacer 76 is arranged between the gear wheel 75 and the blanket cylinder. The blanket cylinder is rotatable on bearings 77 mounted on a shaft 78 supported by adjustment elements 88, 89 on left and right hand upper side plates 80. The gear wheel 75 meshes with a gear wheel 82 rotatably fast with a plate cylinder 15. A spacer 83 is arranged between the gear wheel 82 and the plate cylinder 15. The plate cylinder 15 has integral stub-shafts 84 which are mounted for rotation in bearings 85 supported through adjustable intermediate elements 86,87 by the upper side plates 80. The blanket cylinder 16 can be urged downwards to apply presure to the web supported by the impression cylinder by adjustment elements 88,89 and the plate cylinder can be urged against the blanket cylinder by elements 86,87. Adjustment devices (not shown) are also provided for moving the impression cylinder 27 towards or away from the blanket cylinder.

The upper side plates 80,81 are bed together with bars 92 and along with the cylinders 15,16 form a cartridge 26 slidable to the left clear of the web W as shown in broken lines in FIG. 7.

The upper end plates 80 have lower edges attached to mounting rails 27 which are mounted for sliding on rollers 93 on the main plates 1 (the rollers 93 having horizontal axes) and between rollers 94 having vertical axes. A handle 100 is provided on one of the rails 27 for moving the cartridge 26 to one side. The right hand end of each rail 27 is formed similarly to the left hand end of each rail 25 to enable extensions 95 to be screwed thereon before the cartridge is moved. A dowel location system may be provided similar to the dowel 73 and aperture 71 arrangement for cartridge 26.

As in FIG. 4 the cartridges 21,26 could be movable in opposite directions clear of the web.

Where the cartridges are moved into their FIG. 7 full-line positions, the rollers are rotated slightly by hand if necessary to ensure that the gears 53,64 (see also FIG. 4) of the rollers slide into mesh.

What is claimed is:

1. Printing apparatus allowing for separate replacement of an impression cylinder to prevent ghosting, comprising:

a first print tower having a first printing cylinder and a first impression cylinder mounted in said first print tower for applying print from said first printing cylinder to a first side of a web, the web passing between said first printing cylinder and said first impression cylinder;

a second print tower sequentially after said first print tower and having a second printing cylinder having an axis and a second impression cylinder mounted in said second print tower for applying print from said second printing cylinder to a second side of the web which is opposite said first side of the web, the second impression cylinder in the second print tower contacting said first side of the web, means for removably mounting said second impression cylinder for lateral movement offset and in a direction generally parallel to said second printing cylinder axis second printing cylinder, the web passing between said second printing cylinder and said second impression cylinder;

a replacement first printing cylinder; means for removing the first printing cylinder in the first print tower to be replaced with said replacement first printing cylinder having a diameter different than a diameter of the first printing cylinder, and wherein said replacement first printing cylinder applies ink to the first side of the web a print length not exactly divisible by a circumferential length of the second impression cylinder of the second print tower, wherein said means for removably mounting said second impression cylinder in the second print tower allows movement of said second impression cylinder in said direction separate from the second printing cylinder, to a lateral position offset from the web for replacement of the second impression cylinder in the second print tower, without breaking the web, with a replacement impression cylinder having a circumferential length by which the print length from the replacement first printing cylinder is exactly divisible.

2. Printing apparatus according to claim 1 in which the second impression cylinder is mounted on slide means whereby the second impression cylinder can be slid to the offset position.

3. Printing apparatus according to claim 1 in which the second impression cylinder is mounted between spaced support means.

4. Printing apparatus according to claim 3 in which the support means have surfaces which engage said slide means.

5. Printing apparatus according to claim 3 in which the surfaces are on lower edges of the support means.

6. Printing apparatus according to claim 1 in which the second printing cylinder is mounted between spaced support means independent of support means for the second impression cylinder.

7. Printing apparatus according to claim 6 in which the support means for the second printing cylinder is carried by mounting means which enables the second printing cylinder to be moved to an offset position.

8. Printing apparatus according to claim 7 in which the mounting means is slidable on bearings.

9. Printing apparatus according to claim 1 and further comprising an inverting station located between the first print tower and the second print tower through which the web moves to invert the web prior to printing by said second printing cylinder.

10. Printing apparatus allowing for separate replacement of an impression cylinder to prevent ghosting, comprising:

a printing cylinder having an axis positioned on a first side of a web and having a first circumferential length;

means for applying ink to said printing cylinder wherein said ink is printed from said printing cylinder onto said first side of the web;

a first impression cylinder positioned on a second side of the web which is opposite said first side of the web, said impression cylinder having a second circumferential length;

a replacement impression cylinder;

first support means for holding said printing cylinder on said first side of the web; and, second support means for holding said impression cylinder on said second side of said web, means for mounting said second support means for lateral movement offset and in a direction generally parallel to said printing cylinder axis separate from said first support means, said second support means being laterally movable to move said impression cylinder in said direction laterally offset from the web, wherein said printing cylinder remains in a printing position adjacent the web while said impression cylinder is laterally offset from the web for separate changing of said impression cylinder with said replacement impression cylinder having a third circumferential length, wherein said third circumferential length of said replacement impression cylinder is different than said second circumferential length of said first impression cylinder, and wherein said lateral movement of said second support means and said first impression cylinder occurs outside a plane defined by the web for replacement of said first impression cylinder without replacing said printing cylinder and without breaking the web.

11. Printing apparatus according to claim 10 wherein said separate first support means is laterally movable to a position laterally offset from the web separately from said second support means and said impression cylinder, thereby allowing separate changing of said printing cylinder without breaking the web.

12. Printing apparatus according to claim 11 wherein said second circumferential length is the same as said first circumferential length and is different than said third circumferential length.

13. Printing apparatus according to claim 12 and further comprising means for radially adjusting impression cylinder position radially inward and outward with respect to the reverse side of the web to adjust for impression cylinders of different sizes.

14. Printing apparatus according to claim 13 wherein the web has wet ink printed on the second side of the web prior to the web engaging the impression cylinder, and wherein said impression cylinder contacts said wet ink on the second side of the web.

15. Printing apparatus according to claim 10 and further comprising means for radially adjusting impression cylinder position radially inward and outward with respect to the reverse side of the web to adjust for impression cylinders of different sizes.

16. Printing apparatus according to claim 10 wherein the web has wet ink printed on the second side of the web prior to the web engaging the impression cylinder, and wherein said impression cylinder contacts said wet ink on the second side of the web.

* * * * *

UNITED STATES PATENT AND TRADEMARK OFFICE

CERTIFICATE OF CORRECTION

PATENT NO. : 5,074,205

DATED : December 24, 1991

INVENTOR(S) : John Henry Morgan

It is certified that error appears in the above-identified patent and that said Letters Patent is hereby corrected as shown below:

In Block 76 of the title page, "Cloucestershire" should read --Gloucestershire--

Signed and Sealed this

Thirteenth Day of April, 1993

*Attest:*

STEPHEN G. KUNIN

*Attesting Officer*

*Acting Commissioner of Patents and Trademarks*